US007523931B2

(12) United States Patent
Chiappetta et al.

(10) Patent No.: US 7,523,931 B2
(45) Date of Patent: Apr. 28, 2009

(54) FORWARD AND REVERSE MEDIA ACCUMULATION SYSTEM

(75) Inventors: Anthony W. Chiappetta, Milford, CT (US); James A. Fairweather, Milford, CT (US); James A. Salomon, Cheshire, CT (US); Steven A. Supron, Ithaca, NY (US); Joseph K. Patterson, Monroe, CT (US)

(73) Assignee: Pitney Bowes Inc., Stamford, CT (US)

( * ) Notice: Subject to any disclaimer, the term of this patent is extended or adjusted under 35 U.S.C. 154(b) by 412 days.

(21) Appl. No.: 11/411,684

(22) Filed: Apr. 26, 2006

(65) Prior Publication Data

US 2007/0252324 A1 Nov. 1, 2007

(51) Int. Cl.
*B65H 31/00* (2006.01)

(52) U.S. Cl. ..... 271/207; 271/220; 271/223; 271/241; 271/3.01; 271/3.08

(58) Field of Classification Search ..... 271/207, 271/220, 223, 241, 3.01, 3.05, 3.08
See application file for complete search history.

(56) References Cited

U.S. PATENT DOCUMENTS

| | | | | |
|---|---|---|---|---|
| 4,640,506 | A | 2/1987 | Luperti et al. | |
| 5,147,092 | A * | 9/1992 | Driscoll et al. | 271/184 |
| 5,178,379 | A * | 1/1993 | Edwards et al. | 271/189 |
| 5,354,171 | A | 10/1994 | Mercede | 414/790.2 |
| 5,445,368 | A * | 8/1995 | Lester et al. | 270/59 |
| 5,794,931 | A * | 8/1998 | Heilman et al. | 271/303 |
| 6,203,006 | B1 * | 3/2001 | Semanick et al. | 271/213 |
| 6,644,657 | B2 * | 11/2003 | Wright et al. | 271/242 |
| 6,902,162 | B2 * | 6/2005 | Otto et al. | 271/207 |
| 7,121,544 | B2 * | 10/2006 | Masotta et al. | 271/209 |
| 2003/0080503 | A1 * | 5/2003 | Wright et al. | 271/303 |
| 2003/0151190 | A1 * | 8/2003 | Otto et al. | 271/207 |
| 2007/0013119 | A1 * | 1/2007 | Masotta et al. | 271/3.01 |

FOREIGN PATENT DOCUMENTS

| | | |
|---|---|---|
| EP | 1 334 934 A2 | 2/2003 |

* cited by examiner

*Primary Examiner*—Kaitlin S Joerger
(74) *Attorney, Agent, or Firm*—Ronald Reichman; Angelo N. Chaclas

(57) ABSTRACT

A system and method for accumulation of media invention includes a series of upper and lower transport belts for feeding media seriatim along a path of travel. An accumulator pocket is positioned between the upper and lower drive belts along the path of travel. An upper and a lower accumulator ramp is positioned adjacent the accumulator pocket are moveable between a first position and a second position. The first accumulator ramp position is such that the lower ramp is positioned to engage media moved seriatim along the path of travel to guide the media to form a forward accumulation of media in the accumulator pocket. The upper accumulator ramp second position is such that the upper accumulator ramp is positioned to engage media moved seriatim along the path of travel to guide the media to form a reverse accumulation of media in the accumulator pocket. One or more rollers can be mounted to cooperate with the lower accumulator ramp and one or more rollers can be mounted to cooperate with the upper accumulator ramp to reduce forces which would tend to cause previously assembled media collations to shear apart during transport into the accumulator pocket. The upper and lower accumulator ramps may also be positioned to enable transport of media through the system without the accumulation of media in the accumulation pocket.

8 Claims, 5 Drawing Sheets

FORWARD AND REVERSE MEDIA ACCUMULATION SYSTEM

FIELD OF THE INVENTION

The invention disclosed herein relates generally to system for forward and reverse accumulation of media, and more particularly to a method and apparatus in which media may be forward and reverse accumulated to form media collations.

BACKGROUND OF THE INVENTION

Various systems have been designed to accumulate media into collations. These systems have been for both folded and unfolded media which are accumulated into packets. The media can be individual sheets or a group of previously assembled sheets which are accumulated into packets often for further processing such as insertion into an envelope. Often, the accumulator systems are modules within such larger paper handling equipment such as folders and inserters. The accumulator systems provide a means within the paper handling equipment of assembling the media into a collation or packet prior to further processing such as systems that prepare bills or annual reports for mailing. Moreover, these accumulation systems often must process various types of media such as thin sheets, a group of previously assembled sheets and also stiff sheets which are transported through the accumulator system and are not accumulated into packets.

The accumulation systems have been for both forward and reverse accumulation. Forward accumulation is where the accumulation of media being stacked is in the opposite order in which they are fed into the accumulator. The first media becomes the bottom media in a stack of media or sheets and each subsequent media or sheet is laid on top of the preceding media or sheet. Thus, the forward accumulation of media results in the media being stacked in the opposite order in which they are fed into the accumulator. Reverse accumulation is where the accumulation of the media being stacked is in the order in which they are fed into the accumulator. The first media becomes the top media in a stack of media or sheets and each subsequent media or sheet is laid under the preceding media or sheet. Thus, the reverse accumulation of media results in the media being stacked in the order in which they are fed into the accumulator.

Accumulator systems also often involve various types of media which may be folded. Different types of folds may be implemented such as C-folds, Z-folds, half-folds, cross folds and the like. The specific fold employed depends on the specific application and the functionality of the specific equipment being employed as part of any larger system. For example, a specific application may require certain folded media to be accumulated into packets with an address bearing sheet at the top or the bottom of the collation or packet such that it may after collation with other media be inserted with a specific orientation into a windowed envelope. This is to have the address on the address bearing media be properly positioned behind the envelope window.

It is desirable to develop accumulator systems that have flexibility in their functionality, as well as ease in the mechanism set-up. This helps to increase the productivity of the equipment and also helps to facilitate user choices in running different applications that can involved various media types, folds types and media print order.

When handling stiff media such as stiff sheets as described above, it is advantageous to have a system that does not force the media to deform as it moves seriatim through the media accumulation system. Such a non-deforming mode has multiple advantages, such as the ability to process uniformly stiff media, media having non-uniform bending properties, for example, spine bound booklets, or media having non-uniform thickness.

SUMMARY OF THE INVENTION

It is an object of the present invention to provide an accumulator system that will accommodate both forward and reverse accumulation.

It is an another object of the present invention to provide an accumulator system that will accommodate both forward and reverse accumulation and also enable transport of media through the system without the accumulation of media into collations.

It is a further object of the present invention to provide an accumulator system that is flexible in its operation, accommodating various media types, fold types and print order of media fed into the accumulator.

It is still a further object of the present invention to provide an accumulator system for forward and reverse accumulation for use with an O-ring-type belt transport systems.

A system for accumulation of media embodying the present invention includes a series of upper and lower transport belts for feeding media seriatim along a path of travel. An accumulator pocket is positioned between the upper and lower drive belts along the path of travel. An upper and a lower accumulator ramp is positioned adjacent the accumulator pocket. The upper and the lower accumulator ramp are moveable between a first position and a second position. The first accumulator ramp position is such that the lower ramp is positioned to engage media moved seriatim along the path of travel to guide the media to form a forward accumulation of media in the accumulator pocket. The second accumulator ramp position is such that the upper accumulator ramp is positioned to engage media moved seriatim along the path of travel to guide the media to form a reverse accumulation of media in the accumulator pocket.

A system for accumulation of media also embodying the present invention includes means for feeding media along the path of travel. An accumulator pocket is positioned along the path of travel. A first and a second accumulator ramp are positioned along the path of travel downstream of the accumulator pocket. The first accumulator ramp and the second accumulator ramp have oppositely sloped guide surfaces. The first and second accumulator ramps are adjustable so that one of said first and second accumulator ramp guide surfaces is positioned to engage and guide media moved along said path of travel into said accumulator pocket. A lower guide is mounted along the path of travel below the accumulator pocket and an upper guide is mounted along the path of travel above the accumulator pocket.

In accordance with an aspect of the present invention, a system for accumulation of media embodying the invention includes means for feeding media along the path of travel. An accumulator pocket is positioned along the path of travel. A first and a second accumulator ramp are positioned along the path of travel downstream of the accumulator pocket. The first accumulator ramp and the second accumulator ramp have oppositely sloped guide surfaces. The first and second accumulator ramps are adjustable so that one of the first and second accumulator ramp guide surfaces is positioned to engage and guide media moved along the path of travel into the accumulator pocket. A roller is mounted to cooperate with the lower accumulator ramp and a roller mounted to cooperate with the upper accumulator ramp to reduce forces which would tend to cause previously assembled media collations to shear apart during transport into the accumulator pocket.

A method for accumulation of media embodying the present invention includes feeding media seriatim along the path of travel. A lower accumulator ramp is positioned such that the ramps engages media moved seriatim along said path of travel to guide the media into a collation pocket to form a forward collation of media in the collation pocket. An upper accumulator ramp is positioned such that the ramp engages media moved seriatim along said path of travel to guide the media to form a reverse accumulation of media in the accumulator pocket.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention. As shown throughout the drawings, like reference numerals designate like or corresponding parts.

DETAILED DESCRIPTION OF THE PRESENT INVENTION

Figure 1:
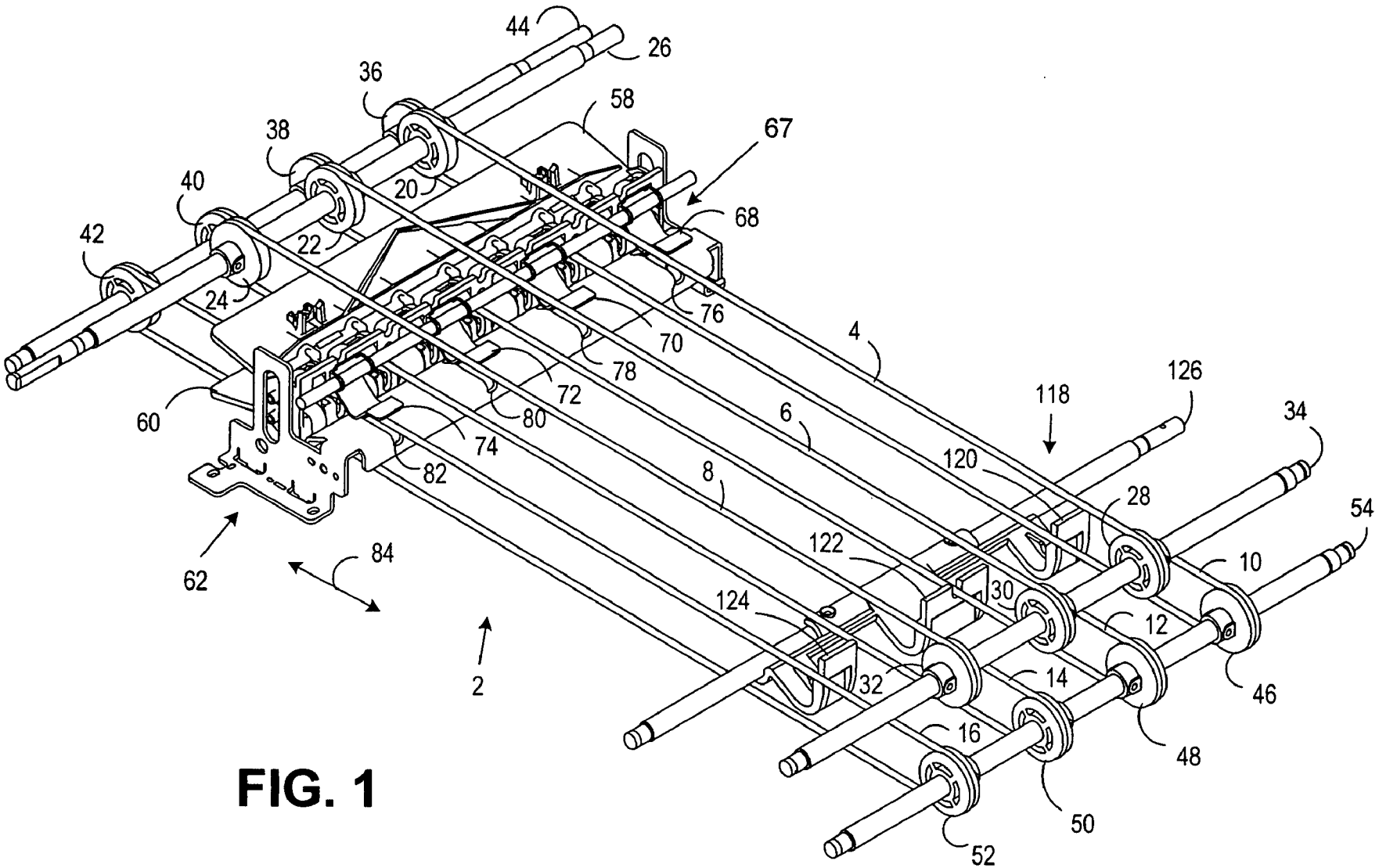
FIG. 1 is a perspective view of an accumulator embodying the present invention with the accumulator ramps of the accumulator guide assembly in the neutral position so that neither forward nor reverse collation occurs.

In describing the present invention, reference is made to the drawings, wherein similar reference numerals in FIGS. 1-7 designate similar elements in the various views.

An accumulator 2 includes three upper O-ring transport belts 4, 6 and 8, which cooperate with four lower transport belts 10, 12, 14, and 16 to transport media such as sheets 126, 127 and 130 (see FIGS. 5, 6 and 7) through the accumulator 2. Various types of O-ring belts and other forms of transport belts may be employed. The belts 4, 6 and 8 are set, respectively, on pulleys 20, 22, and 24 which are mounted for rotation with shaft 26. The belts 4, 6 and 8 are also set, respectively on pulleys 28, 30, and 32. Pulleys 28, 30, and 32 are mounted for rotation with shaft 34. Either shaft 26 or shaft 34 is driven to impart movement to the belts 4, 6 and 8.

In a like manner, O-ring transport belts 10, 12, 14 and 16 are set on pulleys 36, 38, 40 and 42 which are mounted for rotation on shaft 44. The belts 10, 12, 14 and 16 are also set on pulleys 46, 48, 50 and 52 mounted for rotation with shaft 54. Either shaft 44 or 54 is driven to impart movement to the lower transport belts 10, 12, 14 and 16. Each set of O-Ring transport belts, top and bottom, are driven by a shaft. Both of these shafts, shaft 26 and shaft 44, are geared together.

Figure 2:
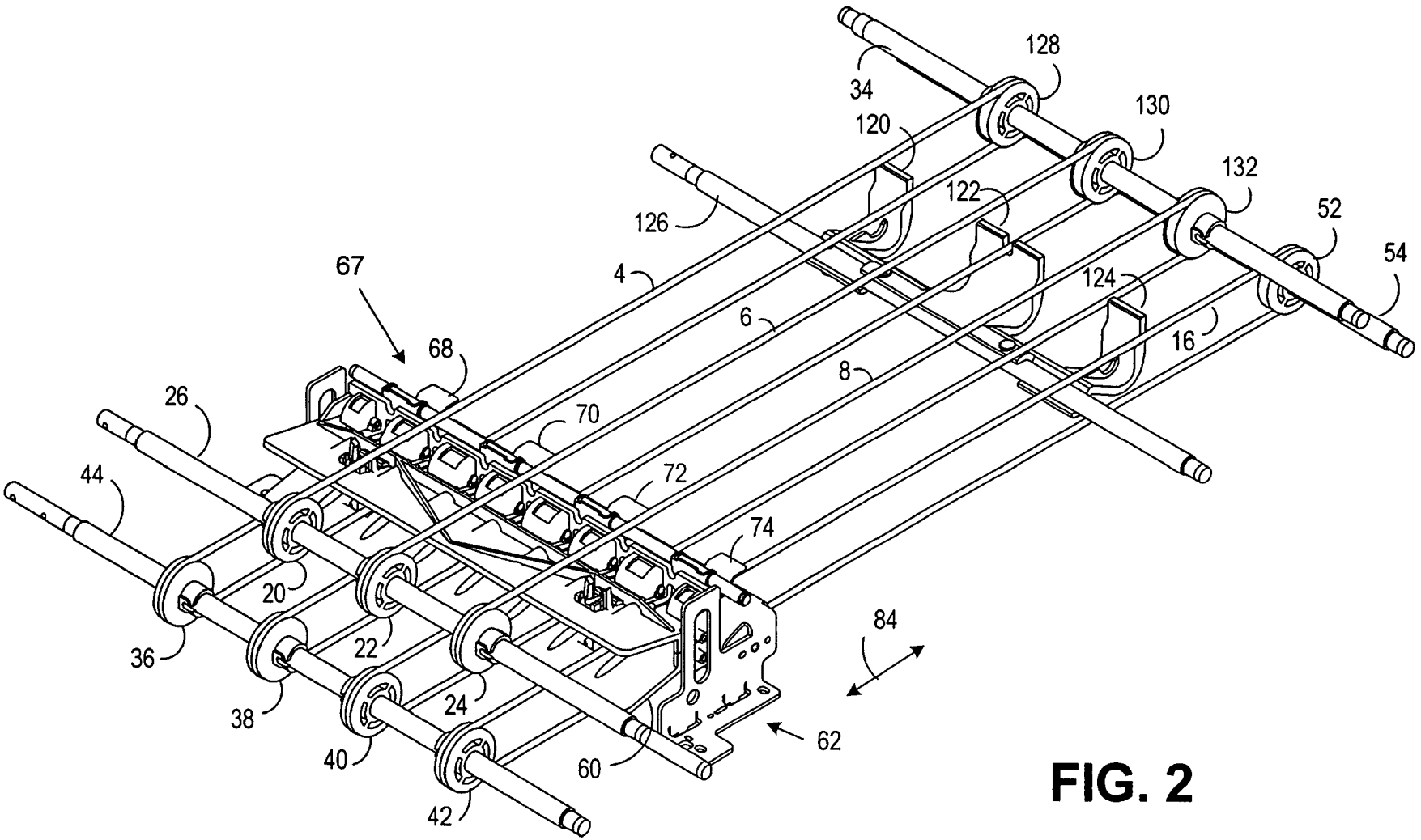
FIG. 2 is a perspective view of the accumulator shown in FIG. 1 from a different angle.
Figure 5:
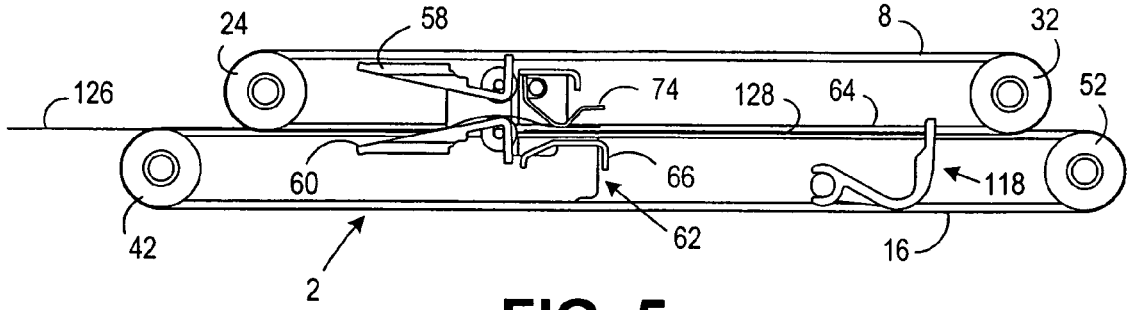
FIG. 5 is a diagrammatic view of the accumulator shown in FIGS. 1 and 2 to illustrate the forward accumulation mode.
Figure 7:
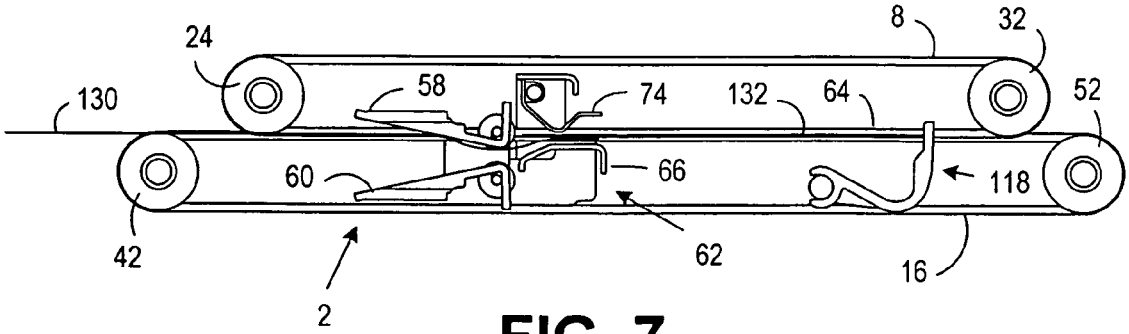

The top series of O-ring belts 4, 6 and 8, and a lower set of O-ring belts 10, 12, 14 and 16, run parallel to the paper path. The upper and lower sets of O-ring belts are inter-digitated (interleaved in a horizontal direction) and overlapped (in a vertical direction) as is shown in FIGS. 1 and 2 such that media such as sheets 126, 127 and 130 being transported will be friction driven, thereby transporting the media through the accumulator system 2. The belts may be positioned to create the desired level of force to transport the media. The media may be slightly corrugated as a result of the forces to achieve the desired friction and transport force. The O-ring belts may be continuously running with individual media or media in the process of being assembled into collations being held at the collation station (pocket) by accumulator pocket gate 118 when in the blocking position. The individual media or completed collation is transported out of the accumulator system 2 when the accumulator pocket gate 118 is moved out of the blocking position As will be explained in greater detail hereinafter, as new media enters the accumulator system 2, the lead edge of the media such as sheet 126, 127 and 130 will be guided by the accumulator ramps 58 and 60 of the accumulator guide assembly 62 to a path either below or above any pre-existing media at the collation station 64, depending upon the position of the accumulator ramps 58 and 60. The lower accumulator ramp 60 has a sloped surface. The surface is sloped upwardly toward said media path of travel for guiding media in an upward direction. The upper accumulator ramp 58 also has a sloped surface. The surface of accumulator ramp 58 is sloped downwardly toward the media path of travel for guiding media in a downward direction. In this way, the lead edge of the media entering the accumulator pocket 64 (as shown in FIGS. 5 and 7) do not collide with the trail edge of any media or partial collation of media previously transported into the collation station or pocket 64. When the accumulator ramps 58 and 60 of the accumulator system 2 is adjusted to enable transport of media through the system without the accumulation of media into collations, the lead edge of the media such as sheet 126, 127 and 130 will remain in a straight path between the top and bottom O-ring belts and not contact either the upper or lower accumulator ramps.

The accumulator ramps 58 and 60 are adjustable in the vertical direction relative the O-ring transport belts to adjust the accumulator system for forward accumulation, reverse accumulation and media transport operation. Downstream of the accumulator ramps 58 and 60, and part of the accumulator guide assembly 62 are a second set of guides. These guides are smaller then the accumulator ramps and are fixed in the vertical direction relative to the O-ring transport belts. These guides include a lower guide 66 and an upper guide 67 formed as a series of pivoting guides members 68, 70, 72 and 74, which pivot on shaft 76.

The guides 66, in association with guide members 68, 70, 72 and 74, form a funnel shaped guide (see FIGS. 5, 6 and 7) which keep the curl and droop of the trail edge of media out of the way of the incoming lead edge of the next media item being fed into the accumulator pocket 64. The lower guide 66 keeps the trail edge of the accumulated sheets from dropping below O-ring belts in the space between the belts. The upper guide members 68, 70, 72 and 74 are individually pivoting guides that press down due to gravity and the weight of the guide member on the media so that the trail edges are pressed against the O-ring belts. The lower guide 66 has a series of channels 76, 78, 80 and 82 to allow free movement of the various O-ring transport belts through the accumulator guide assembly 62. The accumulator guide assembly 62 is adjustable to move along the transport path of the media, as depicted by line 84. This enables the accumulator guide assembly 62 to be positioned to accommodate different length sheets being processed by accumulator 2 by establishing an appropriate size accumulator pocket 64 for the type of media being processed.

Each of the accumulator ramps 58 and 60 have a series of eight rollers mounted at the down stream end of the ramp. Rollers 86, 88, 90, 92, 94, 96, 98, and 100 are mounted to cooperate with accumulator ramp 58. Rollers 102, 104, 106, 108, 110, 112, 114, and 116 are mounted to cooperate with accumulator ramp 60. These accumulator ramp rollers prevent media that has previously been assembled into a collation from shearing apart during transport of the collation into the accumulator pocket 64. These series of ramp rollers enables the transport of relatively large collation into the accumulator pocket 64. The collation can, for example, be in the range of 25 sheets of paper. The collation size will vary depending on the specific implementation for the design and selection of the accumulator components.

Figure 6:
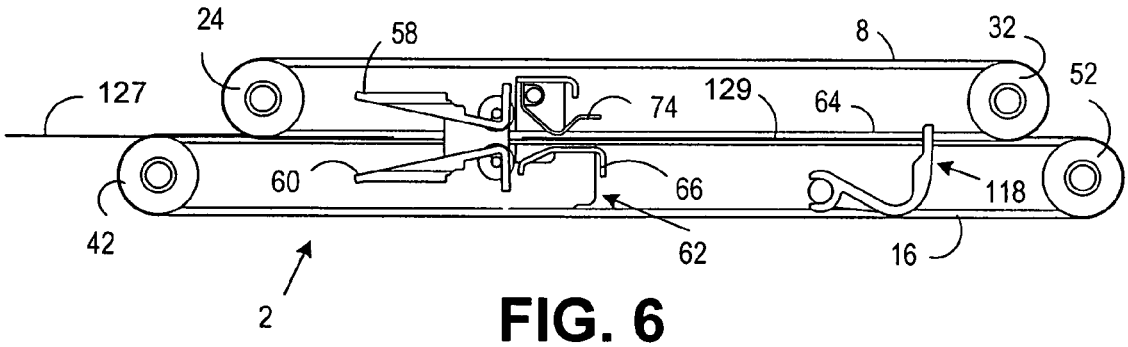
FIG. 6 is a diagrammatic view of the accumulator shown in FIGS. 1 and 2 to illustrate the pass-through mode of operation; and, FIG. 7 is a diagrammatic view of the accumulator shown in FIGS. 1 and 2 to illustrate the reverse accumulation mode of operation.

In operation, when the accumulator ramps 58 and 60 are in their neutral position, as shown in FIGS. 1, 2 and 6, the accumulator system 2 is adjusted to enable transport of media through the system without the accumulation of media into collations. With this adjustment of the accumulator ramps 58 and 60, the accumulator system 2 is not accumulating sheets in the pocket 64. This allows passage of media, such as stiff sheets of material, to be transported through the accumulator system 2. By selectively controlling the position of the accumulator pocket gate 118 between a block and non blocking position, buffering can be provided between media items being transported though the accumulator system 2. This allows control of the space between media being transported seriatim along the accumulator system 2 transport path. The buffering can be employed to allow upstream processes to be completed prior to the transport of the next media item or collation out of the collation pocket 64.

The accumulator pocket gate 118 is formed of three members 120, 122, and 124 mounted for rotation with shaft 126. When the shaft 126 is rotated to position the gate members 120, 122 and 124 into a blocking position, as shown in the various figures, the gate 118 prevents the transport of media by the continuously running O-ring transport belts out of the accumulator pocket 64. When shaft 126 is rotated to position the gate members 120, 122 and 124 into a non blocking position, the members are moved to be out of the path of travel of the media items through the collation station (pocket) 64.

Figure 3:
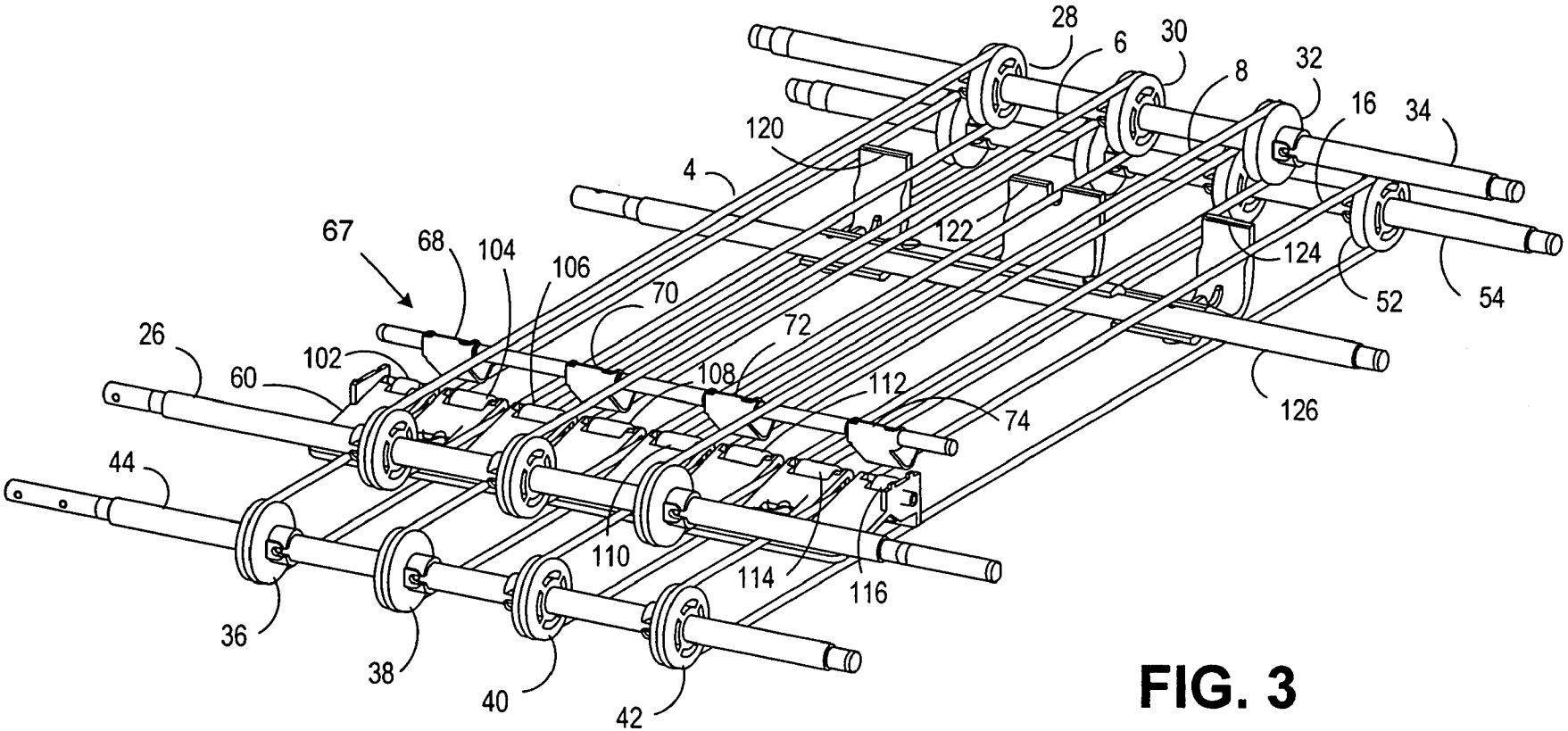
FIG. 3 is a perspective view of the accumulator shown in FIGS. 1 and 2 with the accumulator ramps of the accumulator guide assembly in the forward accumulation position and with the top accumulator ramp assembly and bottom trail edge projection guide removed to expose other components of the accumulator.

In FIGS. 3 and 5, the accumulator ramps 58 and 60 have been adjusted to be in the forward accumulation position. In this position, as illustrated in FIG. 5, a media item, sheet 126, is fed into the accumulator system 2 and is guided by accumulator ramp 60 and its associated rollers 102, 104, 106, 108, 110, 112, 114 and 116 into the accumulator pocket 64. The sheet 126 moves over and on top of sheet 128. Sheet 128 has previously been moved into the accumulator pocket 64 and restricted from forward movement by the accumulator pocket gate 118. In this mode, the upper guide members 68, 70, 72 and 74 bear on the top surface of sheet 126 as it enters the pocket 64.

Figure 4:
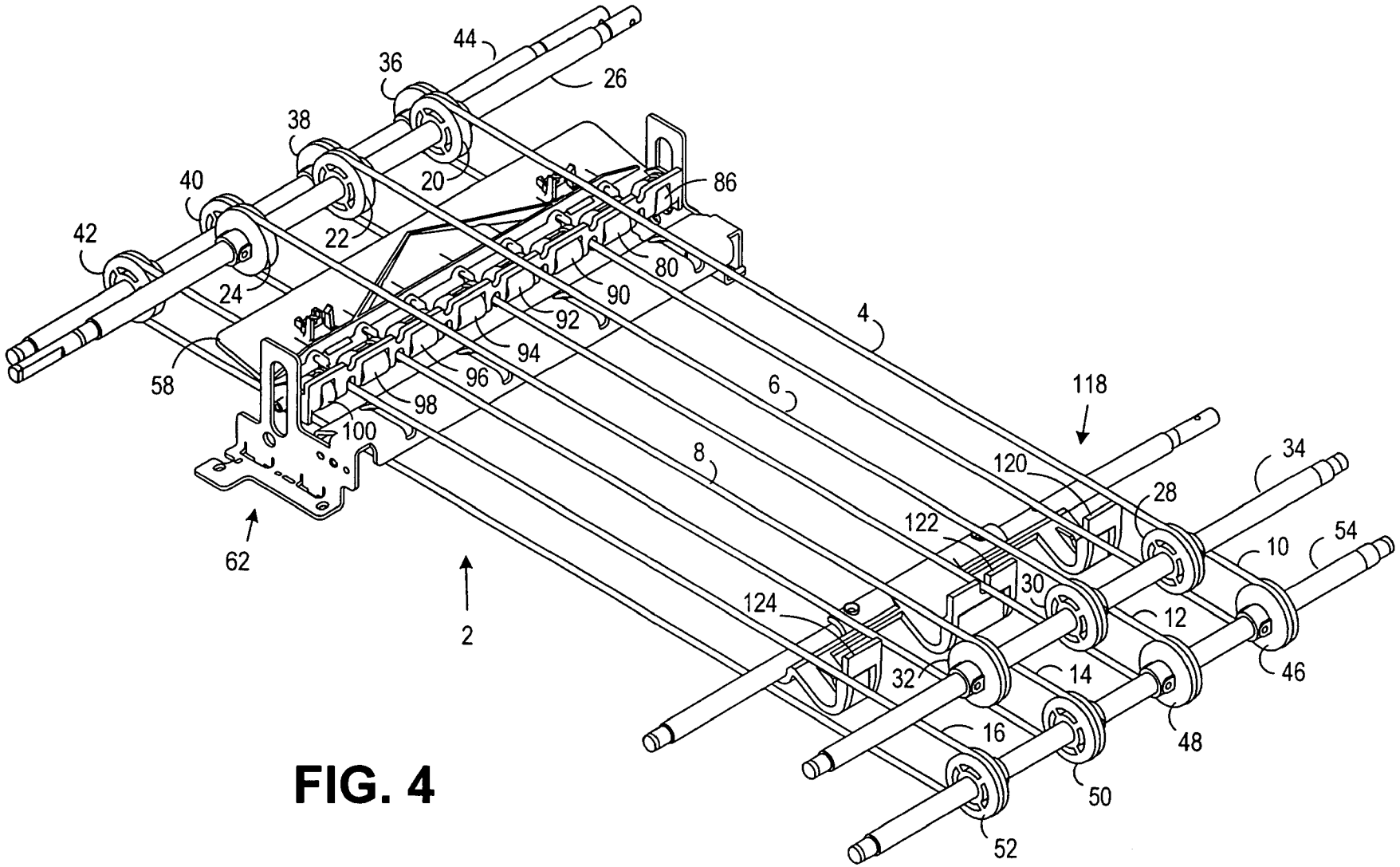
FIG. 4 is a perspective view of the accumulator shown in FIGS. 1 and 2 with the accumulator ramps of the accumulator guide assembly in the reverse accumulation position and with the bottom accumulator ramp assembly and top trailing edge protection guides removed to expose other components of the accumulator.

Accumulator ramps 58 and 60 are adjusted to be in the reverse accumulation position as shown in FIGS. 4 and 7. In this position as illustrated in FIG. 7, a media item, sheet 130, is fed into the accumulator system 2 and is guided by accumulator ramp 58 and its associated rollers 86, 88, 89, 92, 94, 96, 98 and 100 into accumulator pocket 64. The sheet 130 moves under and below sheet 132. Sheet 132 has previously been moved into the accumulator pocket 64 and restricted from forward movement by the accumulator pocket gate 118. In this mode, lower guide 66 supports the bottom of the leading edge of sheet 130 as it enters the pocket 64 while the upper guide members 68, 70, 72 and 74 bear on the top surface of sheet 132.

Accumulator ramps 58 and 60 are adjusted to be in the neutral position as shown in FIGS. 1, 2 and 6. In this position as illustrated in FIG. 6, a media item, sheet 127, is fed into the accumulator system 2 and does not engage either accumulator ramp 58 and its associated rollers 86, 88, 89, 92, 94, 96, 98 and 100 or accumulator ramp 60 its associated rollers 102, 104, 106, 108, 110, 112, 114 and 116 and into the accumulator pocket 64. When ramps are in neutral position for transport only (no accumulating) the ramps and rollers do not need to provide support. The sheet 127 is not fed into the accumulator system 2 for transport into the accumulator pocket 64 until sheet 129 moves out of the accumulator pocket 64. Sheet 129 has previously been moved into the accumulator pocket 64 and restricted from forward movement by the accumulator pocket gate 118. When ramps are in neutral position for transport only (no accumulating) the lower guides, 66 and upper guides 74, do not need to provide support or guidance. The feeding of sheet 127 into the accumulator system 2 and the rotation of the shaft 126 so that the accumulator pocket gate is in the non blocking position is timed so that the two media items, sheet 127 and 129, do not interfere or shingle as they are transported through or buffered by the accumulator system 2. When the accumulator ramps 58 and 60 are adjusted to be in the neutral position, the media moves seriatim through the media accumulation system without being subject to forces that will deform the media. This is particularly useful in processing stiff media of various types.

By positioning the accumulator guide assembly 62 along the paper path and the adjustment of the accumulator ramps 58 and 60, various settings for the accumulator system can be easily implemented between modes to enable forward accumulation operation, reverse accumulation operation and pass-through mode of operation, depending upon the needs of the operator and the job being implemented. Moreover, various media length can also be accommodated. While it is most common to adjust the accumulator guide assembly position along the transport path and the position of the accumulator ramps 58 and 60 between various job runs, due to the extreme ease and flexibility of the arrangement, it is possible to implement the system to change the adjustments of the accumulator system 2 during operation of a job run.

It should be noted that the term media as used herein is intended to include both a single media item such as a single sheet and previously assembled collations of media such as a group of previously assembled sheets. Media also may be folded.

While the present invention has been described in connection with what is presently considered to be the most practical and preferred embodiments, it is to be understood that the invention is not limited to the disclosed embodiment, but, on the contrary, is intended to cover various modifications and equivalent arrangements included within the spirit and scope of the intended claims. For example, various types of transport belts and transport systems can be employed. Moreover, the configuration and placement of the components such as the accumulator ramps and upper and lower guides can be modified. The adjustment of the accumulator ramps and the accumulator assembly can be either manual or automatic. The adjustments can be automatically made by servo motors, solenoids and the like, for example, such as when configuring a large paper handling system to run a specific job or a type of application.

What is claimed is:

1. A system for accumulation of media, comprising:

a series of upper and lower transport belts for feeding media seriatim along a path of travel;

an accumulator pocket between said upper and lower drive belts and positioned along the said path of travel;

an upper and a lower accumulator ramp positioned adjacent said accumulator pocket, said upper and lower accumulator ramp moveable between a first position and a second position; and wherein said upper accumulator ramp positioned to be out of engagement with media moved seriatim along said path of travel when in said first accumulator ramp position and said lower accumulator ramp is positioned to be out of engagement with media moved seriatim along said path of travel moved along said path of travel when in said second accumulator ramp position; and a roller mounted to cooperate with said lower accumulator ramp and a roller mounted to cooperate with said upper accumulator ramp which reduce forces which would tend to cause previously assembled media collations to shear apart during transport into said accumulator pocket; and further comprising a lower guide mounted along said media path of travel downstream of said upper accumulator ramp and said lower accumulator ramp and below said accumulator pocket and an upper pivotable guide mounted along said media path of travel downstream of said upper accumulator ramp and said lower accumulator ramp and above said accumulator pocket, and wherein said upper accumulator ramp, said lower accumulator ramp, said lower guide and said upper pivotable guide are moveable as an assembly along said media path of travel; and said first accumulator ramp position such that said lower ramp is positioned to engage media moved seriatim along said path of travel to guide said media to form a forward accumulation of media in said accumulator pocket; and, said second accumulator ramp position such that said upper accumulator ramp is positioned to engage media moved seriatim along said path of travel to guide said media to form a reverse accumulation of media in said accumulator pocket.

2. A system for accumulation of media as defined in claim 1 wherein said lower accumulator ramp has a sloped surface, said surface sloped upwardly toward said media path of travel for guiding media in an upward direction and said upper accumulator ramp has a sloped surface, said surface sloped downwardly toward said media path of travel for guiding media in a downward direction.

3. A apparatus for accumulation of media as defined in claim 1, wherein said upper accumulator ramp and upper accumulator ramp roller and said lower accumulator ramp and said lower accumulator ramp roller are adjustable in the vertical direction relative to said transport belts and said lower guide and said upper pivotable guide are fixed in the vertical direction relative said transport belts.

4. A system for accumulation of media as defined in claim 3 wherein said upper and lower transport belts are O-ring-type transport belts.

5. A system for accumulation of media, comprising:

means for feeding media along the path of travel;

an accumulator pocket positioned along said path of travel;

a first and a second accumulator ramp positioned along said path of travel upstream of said accumulator pocket, said first accumulator ramp and said second accumulator ramp having oppositely sloped guide surfaces, said first and second accumulator ramps adjustable so that one of said first and second accumulator ramp guide surfaces is positioned to engage and guide media moved along said path of travel into said accumulator pocket; and, a roller mounted to cooperate with said lower accumulator ramp and a roller mounted to cooperate with said upper accumulator ramp which reduce forces which would tend to cause previously assembled media collations to shear apart during transport into said accumulator pocket, wherein said roller mounted to cooperate with said lower accumulator ramp is rotatably mounted to the downstream end of said lower accumulator ramp and a roller mounted to cooperate with said upper accumulator ramp is rotatably mounted to the downstream end of said upper accumulator ramp.

6. A system for accumulation of media as defined in claim 5 further including a plurality of rollers mounted to cooperate with said lower accumulator ramp and each of said plurality of rollers rotatably mounted to the downstream end of said lower accumulator ramp and a plurality of rollers mounted to cooperate with said upper accumulator ramp and each of said plurality of rollers rotatably mounted to the downstream end of said upper accumulator ramp.

7. A system for accumulation of media as defined in claim 5 wherein said first and said second accumulator ramp are further adjustable so that said first and said second accumulator ramp guide surfaces are positioned to enable media to be moved along said path of travel into said accumulator pocket without forming an accumulation of media in said accumulation pocket.

8. A system for accumulation of media as defined in claim 7 wherein said first accumulator guide surface is out of engagement with media moved seriatim along said path of travel and said second accumulator guide surface is out of engagement with media moved seriatim along said path of travel when said first and said second accumulator ramps are in said position to enable media to be moved along said path of travel into said accumulator pocket without forming an accumulation of media in said accumulation pocket.

* * * * *